US005263506A

United States Patent [19]

Narramore

[11] Patent Number: 5,263,506

[45] Date of Patent: Nov. 23, 1993

[54] STAIRS WALKER

[76] Inventor: Daniel Narramore, 3819 E. Camelback, #389, Phoenix, Ariz. 85018

[21] Appl. No.: 941,303

[22] Filed: Sep. 4, 1992

[51] Int. Cl.[5] ..... A61H 3/00

[52] U.S. Cl. ..... 135/67; 135/74

[58] Field of Search ..... 135/67, 74

[56] References Cited

U.S. PATENT DOCUMENTS

| | | | |
|---|---|---|---|
| 906,845 | 12/1908 | Adair | 135/67 |
| 2,708,473 | 5/1955 | Gable . | |
| 2,855,024 | 10/1958 | Robb | 135/67 |
| 3,176,700 | 4/1965 | Drury . | |
| 3,387,617 | 6/1968 | Reiber . | |
| 3,387,618 | 6/1968 | Swann . | |
| 3,421,529 | 1/1969 | Vestal . | |
| 3,455,313 | 7/1969 | King . | |
| 3,800,815 | 4/1974 | Birk . | |
| 4,777,973 | 10/1988 | Nakajima . | |

*Primary Examiner*—Carl D. Friedman
*Assistant Examiner*—Wynn Wood
*Attorney, Agent, or Firm*—LaValle D. Ptak

[57] ABSTRACT

A walker for assisting a physically impaired person in ascending and descending stairs has the four legs pivotally attached to the upper frame of the walker. When the walker is in use, the legs are locked against any pivotal movement; so that the walker provides a stable support for the person using it. When stairs are to be negotiated, a locking member is released to permit relative pivotal movement of the legs with respect to the side portions of the walker frame to be effected. Thus, the front of the frame may be lifted relative to the rear, causing the legs to pivot generally toward the rear by an amount sufficient to permit the front legs to be placed on a step of a staircase. After this has been done, the legs again are locked into position; and the walker maintains this relative position so that the person using it may negotiate the stairs. A reverse of this operation is effected for descending stairs. The locking member is in the form of a rack and pinion gear arrangement with a provision made for preventing relative movement of the legs whenever the locking member is operative.

14 Claims, 2 Drawing Sheets

STAIRS WALKER

BACKGROUND

Lightweight walkers made of aluminum or magnesium are widely used to assist physically impaired persons in walking from place to place. Typically, such walkers comprise an open-sided frame, which is entered from the rear. The frame is self-standing on four legs, and has side rails or arms on it, which conveniently underlie the forearms and elbows of the user. The frame also includes a front bar which the user grasps with his or her hands to lift the walker and rock it from one position to another. When the walker is rocked forward, the user leans on the side rails or arms and steps into the walker, and it is moved forward again, with the sequence being repeated. Many such walkers have telescoping legs; so that the height of the walker may be adjusted to conform to the physical characteristics of the person using the walker.

Although walkers of the type described above are highly suitable for traversing horizontal or nearly horizontal surfaces, they cannot be used on stairways, because they either must be rocked backward or forward in order to place two of the legs on a higher step of the stairway while the other two legs (either the front or the back legs) are placed on a lower step. When this is done, standard walkers are highly unstable and unsafe to use.

Attempts have been made to develop walkers which are adjustable; so that the walkers may be used to negotiate stairs. Two such walkers are disclosed in the U.S. Pat. No. 3,387,617 to Reiber and U.S. Pat. No. 4,777,973 to Nakajima. Both of these patents disclose mechanisms for adjusting the relative lengths of the front and rear legs of the walker to permit stairs to be negotiated using the walker. In both of these patents, the adjustment is effected from the position of use by operating levers located near or at the top of the walker frame.

The device of Nakajima has telescoping legs in each of the four leg positions. The frame, which supports the legs, is a hollow pipe; and spherical balls fill the pipe between the tops of the two legs on each side. An adjustment lever located in the top side rail normally is inserted between adjacent pairs of balls to keep them from moving in either direction. When stairs are to be negotiated, the lever is pulled out of the path of the balls, and the walker is tipped forward or backward to obtain the desired relative lengths of the front and rear legs. When the desired length is achieved, the lever is depressed, and inserted between adjacent balls once again to hold them in place. Although this apparatus provides a relatively straightforward means of adjusting the relative lengths of the legs when pressure is applied to them, the device requires a frictional fit to prevent the legs from sliding to their most extended position when the walker is lifted or raised to negotiate the next step, or when the walker is used on the level. This requirement is a significant disadvantage, since such a frictional engagement typically will loosen in time; so that it becomes difficult for a physically impaired person to use the device, or at least to use the device with any degree of confidence.

The patent to Reiber has an adjustment provision for the front legs only. A thumb-actuated cam locking control is provided to lock (and, subsequently, to release) telescoping front legs of the walker into the desired position. The adjustment is made of the legs on both sides of the walker simultaneously.

Additional walkers have been patented, which employ telescoping legs to permit adjustment of the relative lengths of the front and rear legs for use of the walker on stairs. Devices of this type are shown in the U.S. Pat. No. 3,176,700 to Drury; U.S. Pat. No. 3,421,529 to Vestal; U.S. Pat. No. 3,455,313 to King; and U.S. Pat. No. 3,800,815 to Birk. All of the devices of these patents require individual adjustments to each of the legs at a point near the lower end of the legs. Such adjustments usually are difficult to make for a physically impaired person. In addition, the requirement for each of the four legs to be individually adjusted is a significant disadvantage to the use of the walkers disclosed in these patents.

Another disadvantage of all of the walkers of the patents discussed above is that the adjustment of the legs simply is effected by extending, collapsing or telescoping the legs, which otherwise extend in a fixed position from the upper support surface of the walker. Thus, when the walker is placed at an angle on a stairway, the stability of the walker is less than its stability on level ground, since the center of gravity, with respect to the contact point of the legs, moves from the center of the walker to a point which is generally closer to the forward legs on the walker when it is used to descend stairs, and closer to the rear legs when the walker is used to ascend stairs.

It is desirable to provide a walker which is readily adjustable to ascend or descend stairs, which readily may be operated by a physically impaired person from a normal position or use of the walker, and which provides greater stability in use than the devices of the prior art.

SUMMARY OF THE INVENTION

Accordingly, it is an object of this invention to provide an improved walker for physically impaired persons.

It is another object of this invention to provide an improved walker for assisting physically impaired persons in ascending and descending stairs.

It is an additional object of this invention to provide an improved, readily adjustable walker for physically impaired persons to assist such persons in using such a walker in ascending and descending stairs.

It is a further object of this invention to provide an improved walker, which is readily adjustable for either ascending or descending stairs, which employs pivoted legs descending from the upper frame of the walker, whereupon the legs may be firmly locked in place once the relative lengths of the front and rear legs have been adjusted by pivoting them to a desired position.

In accordance with a preferred embodiment of the invention, a walker for assisting a physically impaired person in ascending and descending stairs comprises an upper, generally U-shaped frame. This frame has a front portion and left and right side portions which are interconnected together. The first ends of the side portions are connected to the front portion; and the second ends are open to provide access for a person to the walker in a conventional manner.

First and second sets of front and rear legs are pivotally attached at the upper ends to the left and right side portions of the frame. A mechanism, operable by the user of the walker from the U-shaped frame, locks the front and rear legs of the first and second sets of legs in different angular relationships with respect to the left and right side portions of the upper frame to adapt the walker for use on level ground, or for ascending or descending stairs.

DETAILED DESCRIPTION

Reference now should be made to the drawings, in which the same reference numbers are used throughout the different figures to designate the same components.

Figure 1:
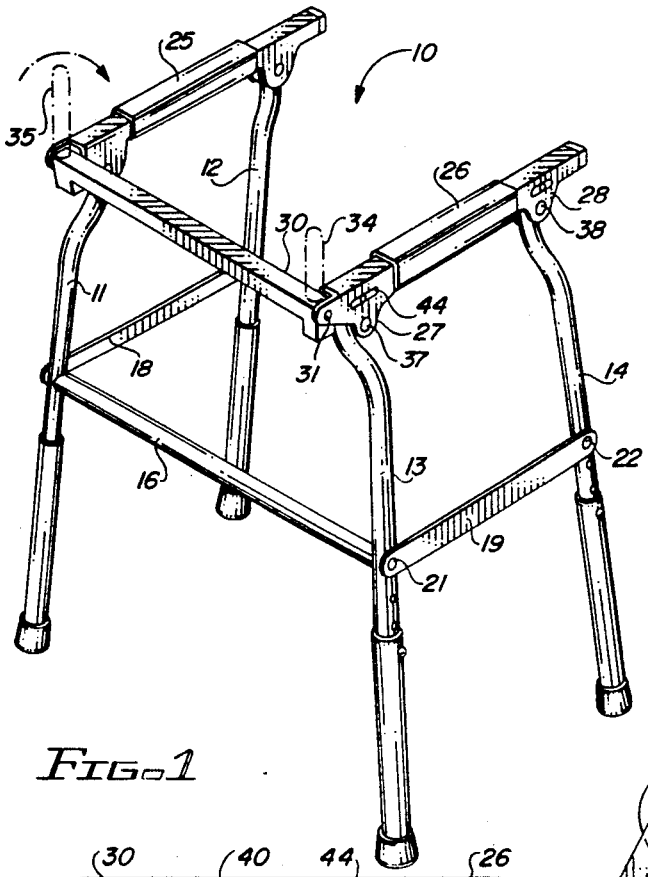
FIG. 1 is a front perspective view of a preferred embodiment of the invention.
Figure 2:
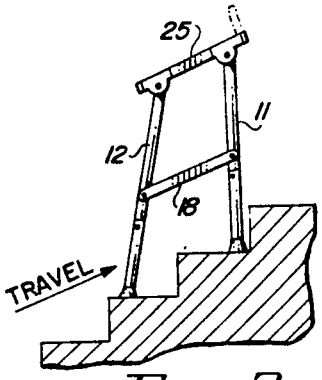
FIGS. 2 and 3 are side diagrammatic views of the embodiment of FIG. 1, showing it used to ascend and descend stairs, respectively.
Figure 3:
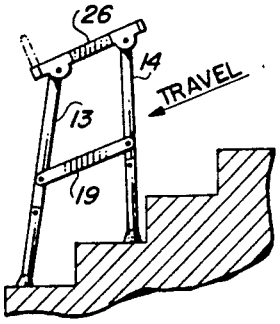

FIG. 1 is a perspective view of a walker, which may be used by a physically impaired person for moving across a horizontal surface or for ascending or descending stairs (see FIGS. 2 and 3, respectively). The general configuration of the walker shown in FIG. 1 is that of a standard lightweight aluminum or magnesium walker. The walker includes four legs 11, 12, 13 and 14 extending substantially downwardly, although flaring outwardly slightly from each of the four corners of the walker, to provide greater stability for the user. These legs are attached to a pair of side arms 25 and 26, which in turn are interconnected together at their forward ends by a front bar 30. Additional stability for the walker is provided by a front brace 16 between the legs 11 and 13 at approximately the mid-point of their length. Side braces 18 and 19 connect the legs 11/12 and 13/14, respectively.

If desired, the legs 11, 12, 13 and 14 may be telescoping, as shown, so that the height of the walker, that is the distance from the top of the arms 25 and 26 to the ground, may be adjusted to accommodate the physical characteristics of different persons who may use the walker. The general construction, which has been described thus far, is standard for walkers in widespread use, used by physically impaired people to move over horizontal or nearly horizontal surfaces. Standard walkers are constructed of a relatively rigid nature; so that the relative orientation of the parts which are shown in FIG. 1 always remains the same.

The walker of FIG. 1, however, is not a standard walker, and is capable of different relative orientations of the parts, as illustrated diagrammatically in FIGS. 2 and 3, to permit the walker to be used to ascend steps (FIG. 2) or descend steps (FIG. 3), while providing a solid support for the user of the walker.

The manner in which this is accomplished is best understood from an examination of the walker of FIG. 1 taken in conjunction with the cross-sectional detailed illustrations of FIGS. 4 through 7. These figures show details of a portion of the apparatus located within the left side arm 26 of the walker. It is to be understood that the mechanism, which is illustrated in FIGS. 4 through 7, also is present in the arm 25. Only the details of one portion of the apparatus, however, is shown, since to show such details for each of the legs 11, 12, 13 and 14 would be redundant and is unnecessary.

The arms 25 and 26 are hollow, and within the arms 25 and 26 (arm 26 being shown in FIG. 4 through 7) there is an elongated bar 40 arranged for limited longitudinal sliding movement within the arm 26 from end to end. The bar 40 comprises a pair of racks on each end with teeth 41 on the lower surfaces to engage corresponding set of teeth 51 of a generally circular gear segment 50 secured to the top of the leg 13 (as shown in FIG. 4 through 7). This connection of the gear 50 is made through a downward extension 53 attached to the hollow leg 13 by means of a pair of rivets 54. A similar configuration (not shown) exists for each of the other legs 11, 12 and 14.

Figure 4:
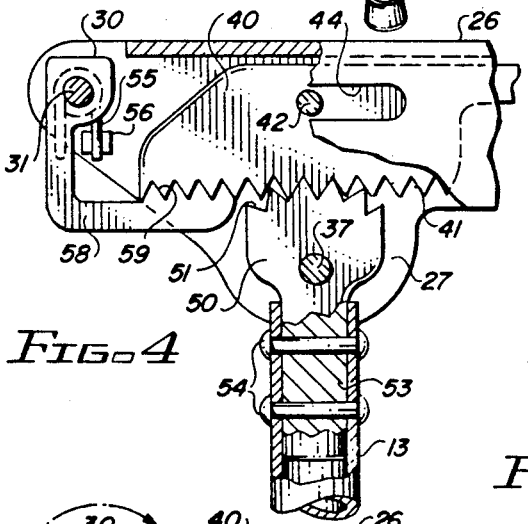
FIG. 4 is a detailed partially cut-away view of a portion of the device shown in FIG. 1.

In the position shown in FIG. 4, the walker is used for movement over horizontal surfaces. The rack 40 is prevented from longitudinal movement within the arm 26 (and a similar rack also is prevented from movement within the arm 25) by means of a toothed locking lever 58, which has a set of teeth 59 to engage teeth 41, located adjacent the teeth 51 on the top portion 50 of the extension of the leg 13. The lever 58 extends downwardly from the front bar 30 of the upper portion of the frame of the walker 10, and is biased into engagement with the teeth 41 of the rack 40 by means of a spring 55, which is anchored in a bracket 56 located within a downwardly extending ear 27, which supports a pivot 37 on which the gear 50 for the leg 13 rotates. When rotation of the leg 13 (and all of the other legs 11, 12 and 14) is desired, the bar 30 is rotated in a clockwise direction, as shown most clearly in FIG. 5. This is done against the action of the spring 56, and most conveniently, can be accomplished by means of a pair or upright handles 34 and 35 (shown in dotted lines in FIG. 1) by pulling these handles backward. This then releases the rack 41 for longitudinal movement within the arm 26 (and a similar rack for longitudinal movement within the arm 25).

If the walker then is to be used for ascending stairs, the front of the walker frame is lifted to lift the front legs 11 and 13 off the ground. This permits the front legs 11 and 13 to pivot about the pivots 37, and the rear legs 12 and 14 to pivot about similar pivots 38 in the brackets 27 and 28 to the relative position, with respect to the side arms 26 and 25, shown in FIG. 6.

Figure 6:
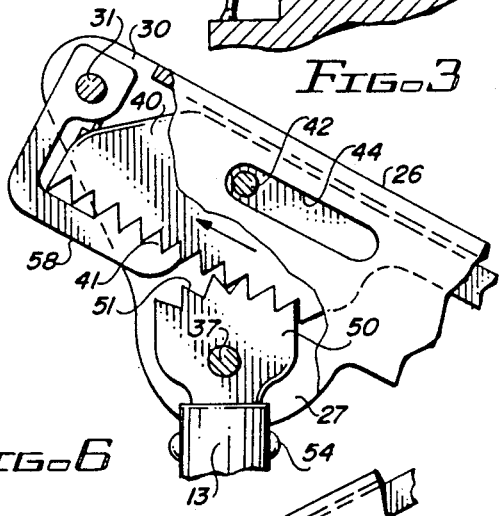
FIGS. 6 and 7 show the relationship of the parts in FIG. 4 for the ascending and descending modes of operation diagrammatically illustrated in FIGS. 2 and 3.
Figure 5:
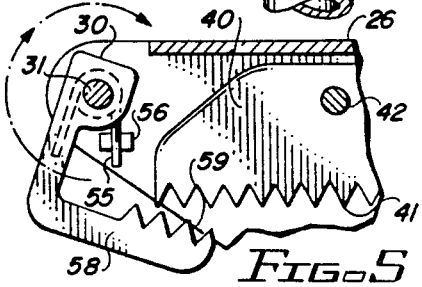
FIG. 5 is a partially cut-away detail view of the portion shown in FIG. 4 in a different state of operation.

This pivoting action, with the locking bar 58 in the position shown in FIG. 5, moves the rack 40 in the direction of the arrows shown in FIG. 3 to a maximum distance determined by the length of an elongated slot 44 and a stop pin 42 extending from the rack 40 into the slot 44. This maximum position is shown in FIG. 6. When this position, or any intermediate position between the ones shown in FIG. 4 and FIG. 6, is desired, the bar 30 is released to permit it to rotate back into the position shown in FIGS. 4 and 6 where the teeth on the lever 58 lock into the teeth 41 on the lower surface of the rack 40 to lock all of the parts shown in the position shown in FIG. 6. The walker then is configured for ascending stairs, as shown in FIG. 2. There is no further rotation of the legs 11, 12, 13 and 14, since the rack 40 is held firmly in position, and the intermeshed teeth 51 of the gears on the upper portion of the leg 13 (and the other legs) with the teeth 41 prevent rotation of the legs 11, 12, 13 and 14.

It also should be noted from an examination of FIGS. 1, and 3, that the side brace members 18 and 19 are pivotally attached to the corresponding legs 11/12 and 13/14 by means of pivots 21 and 22. As a consequence, when the legs are permitted to rotate to the position shown in FIG. 6, the effect of the braces 18 and 19 is that of a parallelogram; so that when the locking bar or lever 58 is released to return it under the control of the spring 55 to the position shown in FIG. 6, a highly stable device exists. Also, since the legs 11 and 13 extend outwardly somewhat forward from the front end of the arms 25 and 26, and, similarly, since the legs 12 and 14 extend outwardly toward the rear of the walker from the arms 25 and 26 in its horizontal use, the reconfiguration of the walker to the position shown in FIG. 2, still provides a very stable device, with a center of gravity maintained substantially at the mid-point of the arms 25 and 26. Because of the parallelogram action, the rear leg 12, which is required to carry the most weight, extends at a greater angle from the arms 25 than the front legs 11 and 13, which rest on the upper steps.

Figure 7:
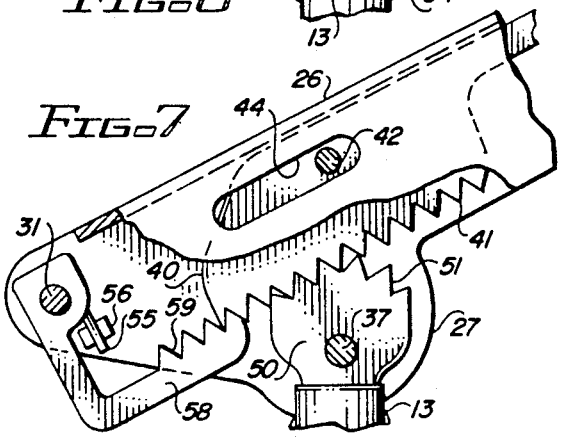

Reference now should be made to FIGS. 5 and 7, which show the reverse operation to configure the walker for descending stairs, as shown in FIG. 3. The same technique is used. First, the locking bar 58 is released as shown in FIG. 5, the rear of the walker is raised relative to the front to cause the legs 11, 12, 13 and 14 to pivot to the relative position shown for the leg 15 in FIG. 7. After this position has been reached, the locking bar is released and the end teeth 59 on the locking bar engage the end teeth 41 of the rack, which has moved to its rearmost position, as illustrated in FIG. 7. The walker then is configured for descending stairs, as shown in FIG. 3.

Figure 8:
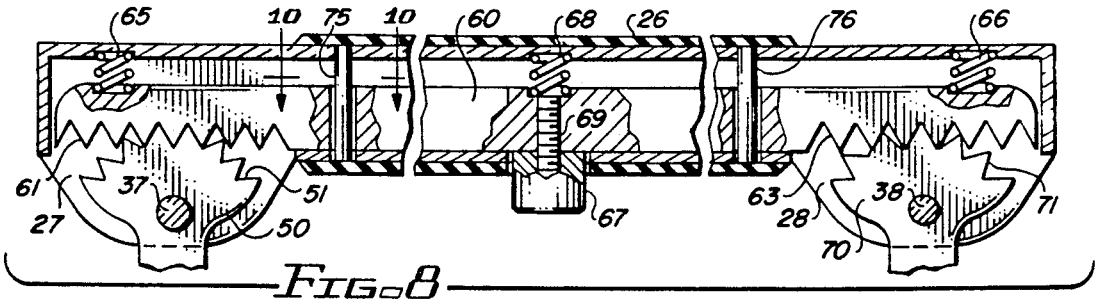
FIG. 8 is a partially cut-away side view of an alternative to the embodiment shown in FIGS. 4 through 7.

FIGS. 8 to 13 illustrate an alternative to the embodiment shown in FIGS. 1 and 4 through 7. In the embodiment of FIG. 8, however, the toothed rack 40 of the embodiment of FIGS. 1 and 4 through 7 has been replaced with a rack 60, again having teeth 61 and 62 on the lower portions facing the tops of the legs 13 and 14 (and a similar structure for the legs 11 and 12, not shown). The rack 60, however, is not designed for longitudinal movement within the arm 26. Instead, it is spring biased downwardly to engage the top teeth 51 and 71 of upper circular gears 50 and 70, respectively, located above the pivots 37 and 38 for the legs 13 and 14. A pair of rods 75 and 76 are attached to the upper and lower surfaces of the hollow arm 26; and these rods pass through corresponding holes through the bar 60; so that it is capable of reciprocating movement in the vertical direction, but is prevented from any movement longitudinally within the arm 26.

The bar 60 is spring biased to the position shown in FIG. 8 by means of coil springs 65, 66 and 68. The spring 68 is located directly above a push button 67, which is secured by means of a screw 69 to the bar 60. The push button 67 extends outwardly through a circular opening in the underside of the arm 26. A similar structure exists for the arm 25, but only the structure for the arm 26 has been shown in order to avoid cluttering of the drawing.

Figure 9:
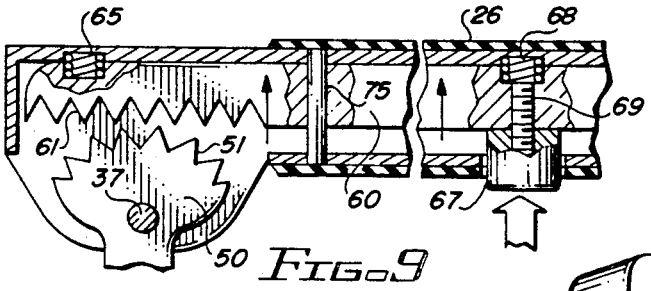
FIGS. 9 through 12 illustrate different steps of the operation of the embodiment shown in FIG. 8.
Figure 10:
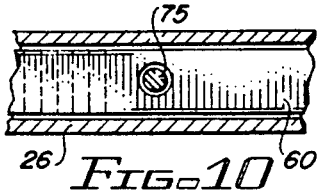
Figure 11:
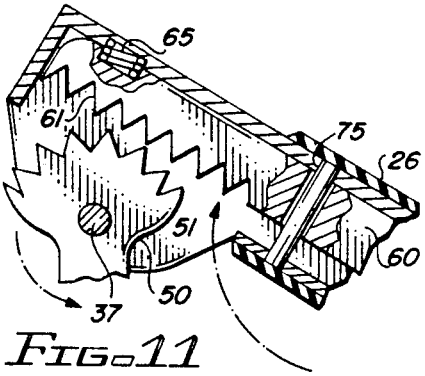

In the position shown in FIG. 8, the walker is configured essentially as shown in FIG. 1, and is used for movement over substantially horizontal surfaces. When it is desired to use the walker to negotiate stairs, the push button 67 in the arm 26 is depressed, as shown in FIG. 9. The similar push button on the arm 25 also is depressed. This then compresses the springs 65, 66 and 69, as shown in FIG. 9, to lift the teeth 61 and 63 on the opposite ends of the bar 60 out of engagement with the corresponding teeth 51 and 71 on the gears 50 and 70 on the top of the legs 13 and 14. This is illustrated in FIG. 9 for the gear 50. The front (or back) of the walker frame, comprised of the arms 25, 26 and the front portion 30, then may be raised to cause relative rotation of the four legs 11, 12, 13 and 14 with respect to the arms 25, 26 and the bar 60 to the position shown in FIG. 11 (for use of the walker to ascend stairs, as shown in FIG. 2). Once the desired rotational position or relative height of the front legs with respect to the rear legs has been achieved, the push button 67 is released. This then causes the bar 60 to reengage the teeth 61 and 63 with the teeth 51 and 71, as illustrated in FIG. 12.

Figure 12:
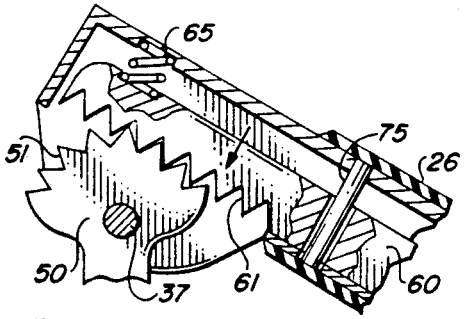

Since the pins or rods 75 and 76 prevent longitudinal movement of the bar 65 within the arm 26, a solid interconnection of the legs 11, 12, 13 and 14 at the angle shown in FIG. 12 is effected; so that the walker may be used to ascend stairs. A similar operation may be effected to cause the relative position of the teeth 61 and 63 of the rack 60 and the teeth 51 and 71 on the gears 50 and 70 at the ends of the legs to be made for setting up the walker to descend stairs, as described above in conjunction with FIG. 7 for the embodiment shown in FIGS. 1 and 4 through 7.

Figure 13:
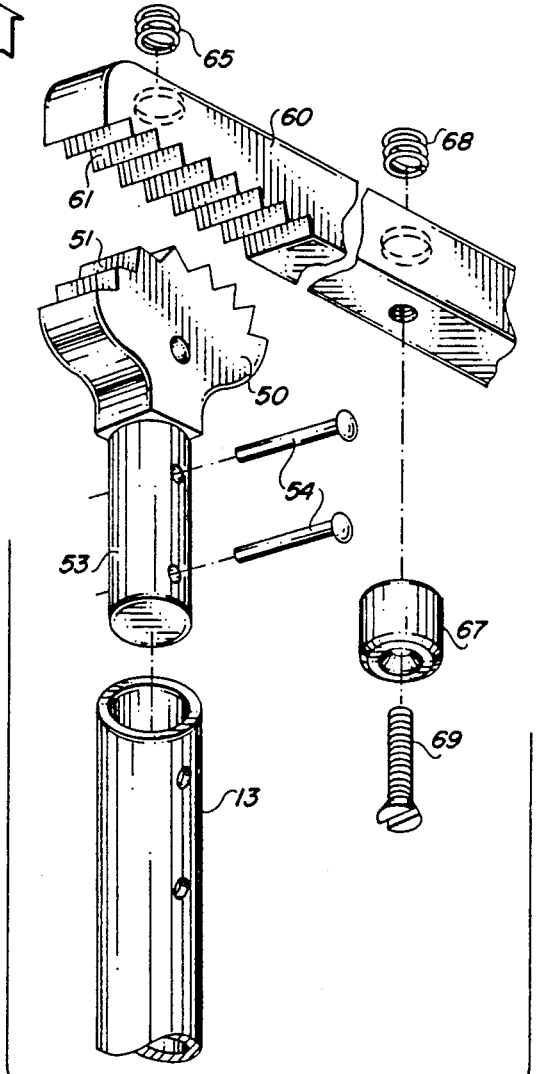
FIG. 13 is an exploded view of some of the parts shown in the embodiment of FIG. 8.

FIG. 13 illustrates, in exploded view, various ones of the parts which are used in the embodiment of FIGS. 8 through 12. The manner of connecting the extension 53 of the gear top 50 to the elongated hollow leg 13 (and the other legs 11, 12 and 14) is clearly illustrated in the exploded view of FIG. 13.

The foregoing description of the preferred embodiments of the invention should be considered as illustrative and not as limiting. Different mechanisms may be used to lock the legs in position. Other types of pivot mechanisms may be used. It may be desirable to use cams, instead of rack and pinion gear arrangements, for holding the legs in the different relative positions required for negotiating stairs and the like. Other changes and modifications will occur to those skilled in the art, without departing from the true scope of the invention as defined in the appended claims.

I claim

1. A walker for assisting a physically impaired person in ascending and descending stairs including in combination:

an upper, generally U-shaped frame having a front portion and left and right side portions, each of said side portions having first and second ends, with the first ends of said left and right side portions connected to said front portion;

first and second sets of front and rear legs, each of said legs having upper and lower ends and with the upper ends of the front legs of said first and second sets pivotally attached to the first ends of said left and right side portions, respectively, of said frame, and the upper ends of said rear legs of said first and second sets pivotally connected to the second ends of said left and right side portions of said frame, respectively; and means for locking said front and rear legs of said first and second sets in different angular relationships with respect to said left and right side portions of said upper frame.

2. The combination according to claim 1 further including left and right intermediate brace members pivotally attached across the front and rear legs of each of said first and second sets, with said first and second brace members oriented parallel to said left and right side portions, respectively, of said upper frame for causing said front and rear legs of each said first and second sets of legs to pivot by the same amount with respect to said left and right side portions of said upper frame.

3. The combination according to claim 2 wherein the upper end of at least one of said front and rear legs of each of said first and second sets terminates in teeth on a substantially circular gear-toothed portion located above the pivotal attachment of the upper ends of said legs; and further including a linear rack on said left and right side portions of said frame with mating teeth for engaging the teeth on the upper end of said leg; and means for adjusting the relative rotational position of said leg with respect to said rack for effecting said different angular relationships.

4. The combination according to claim 3 wherein said means for locking said front and rear legs of said first and second leg sets in different angular relationships comprises means pivotally coupled with said front portion of said U-shaped frame.

5. The combination according to claim 3 wherein said rack on each of said left and right side portions is spring biased into engagement with the teeth on the upper end of said at least one leg for locking said leg in a fixed angular relationship with respect to said left and right side portions of said frame; and further including means for moving said rack out of engagement with the teeth on said leg to permit said leg to rotate freely with respect to said left and right side portions whereupon re-engagement of said rack with the teeth on the top of said leg locks said leg in different angular relationships with respect to said left and right side portions upon such re-engagement of said rack with the teeth on the upper end of said leg.

6. The combination according to claim 5 wherein said front and rear legs of each of said first and second sets of legs extend outwardly beyond said first and second ends of said left and right side portions when said left and right side portions are substantially parallel to the ground.

7. The combination according to claim 6 further including means for pivoting said locking member to release said rack members for longitudinal movement with respect to said left and right side portions.

8. The combination according to claim 1 further including a sliding rack member in each of said left and right side portions of said upper frame capable of longitudinal movement with respect to each such side portion to a limited extent, and wherein the upper end of at least one of said legs of each of said first and second sets is in the form of a circular toothed gear, the teeth of which engage the teeth of said rack members, and wherein said means for locking said front and rear legs comprises a pivoted toothed member for engaging the teeth of said rack members to prevent said rack members from longitudinal movement with respect to said side portions, whereupon release of said locking member permits rotation of said legs with respect to said left and right side portions effecting predetermined longitudinal movement of said rack and effecting said different angular pivotal relationships of said legs with respect to said left and right side portions.

9. The combination according to claim 8 further including means for limiting the longitudinal movement of said rack relative to said left and right side portions.

10. The combination according to claim 9 wherein said means for locking said front and rear legs of said first and second leg sets in different angular relationships comprises means pivotally coupled with said front portion of said U-shaped frame.

11. The combination according to claim 1 wherein said front and rear legs of each of said first and second sets of legs extend outwardly beyond said first and second ends of said left and right side portions when said left and right side portions are substantially parallel to the ground.

12. The combination according to claim 1 wherein the upper end of at least one of said front and rear legs of each of said first and second sets terminates in teeth on a substantially circular gear-toothed portion located above the pivotal attachment of the upper ends of said legs; and further including a linear rack on said left and right side portions of said frame with mating teeth for engaging the teeth on the upper end of said leg; and means for adjusting the relative rotational position of said leg with respect to said rack for effecting said different angular relationships.

13. The combination according to claim 12 further including means for pivoting said locking member to release said rack members for longitudinal movement with respect to said left and right side portions.

14. The combination according to claim 13 further including means for limiting the longitudinal movement of said rack relative to said left and right side portions.

* * * * *